United States Patent [19]

Batigne et al.

[11] Patent Number: 4,541,976

[45] Date of Patent: Sep. 17, 1985

[54] METHOD OF MANUFACTURING CYLINDRICAL CERAMIC TUBES HAVING LOCALIZED IMPRINTS ON THEIR INNER FACES

[75] Inventors: Jean Batigne, Enghien-les-Bains; Claude Deslandes, Montpellier; Jacques Gillot, Laloubere; Paul Tritten, Tarbes, all of France

[73] Assignee: Commissariat a l'Energie Atomique, Paris, France

[21] Appl. No.: 396,108

[22] Filed: Jul. 7, 1982

[51] Int. Cl.[4] ..... B28B 21/52

[52] U.S. Cl. ..... 264/69; 138/37; 264/150; 264/159; 264/320; 264/322; 425/297; 425/363

[58] Field of Search ..... 264/69, 71, 293, 150, 264/159, 320, 322; 425/385, 297, 363

[56] References Cited

U.S. PATENT DOCUMENTS 4,324,540 4/1982 Sextone ..... 425/385

FOREIGN PATENT DOCUMENTS 759777 2/1934 France .
1150246 1/1958 France .
2073777 10/1971 France .
1426837 9/1937 Japan .
202542 2/1942 Japan .

*Primary Examiner*—James Derrington
*Attorney, Agent, or Firm*—Oblon, Fisher, Spivak, McClelland & Maier

[57] ABSTRACT

A method of making imprints on the walls of portions of a tube obtained by the continuous molding of a ceramics-based paste and the cutting up of the tube, wherein immediately after the tube portions have been molded and are still deformable, they are placed on means parallel with the axis of the tube portions for rotating them around their axes of revolution, means are applied to the rotary means for exerting a pressure on at least a portion of the tubes so that such portions are clamped between the rotary means and the pressure-exerting means, the pressure-exerting means or the rotary means are provided with at least one imprint-making tool, the or each tool having a main direction which does not coincide with the direction of the axes of revolution of the tube portions, and means are applied to create a second relative movement between the tube portion and the or each tool, so that there is substantially no sliding between the tube portion and the or each tool. The tubes are useful in gas diffusion processes.

17 Claims, 23 Drawing Figures

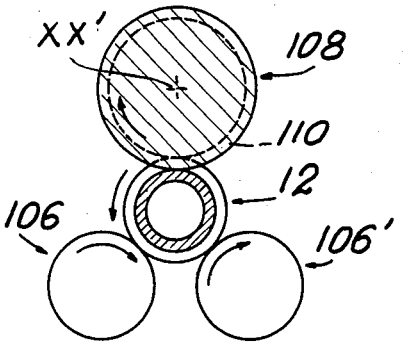
FIG.6'a
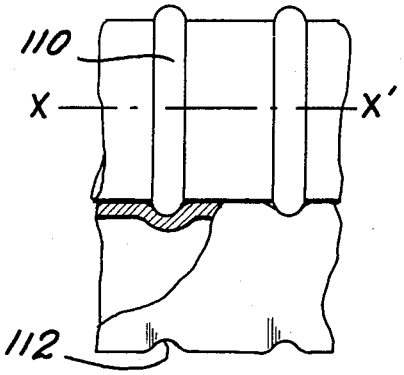
FIG.6'b
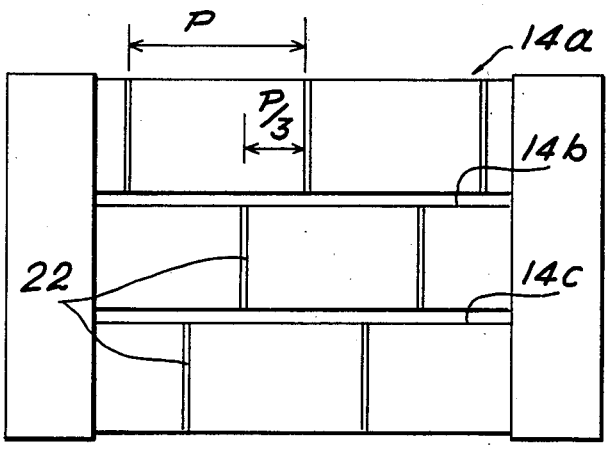
FIG.9
FIG.10
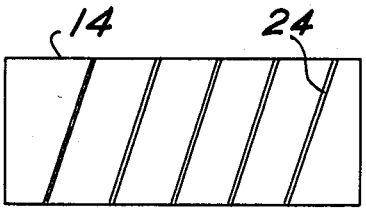
FIG.11
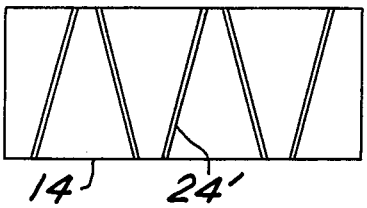
FIG.12
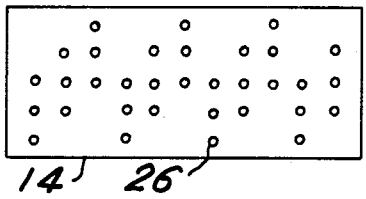

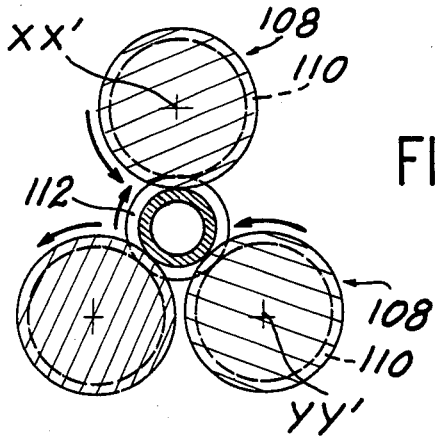
FIG. 6"a
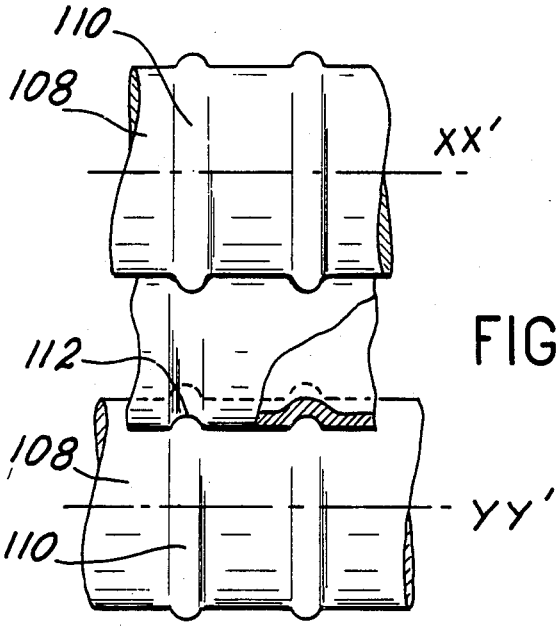
FIG. 6"b

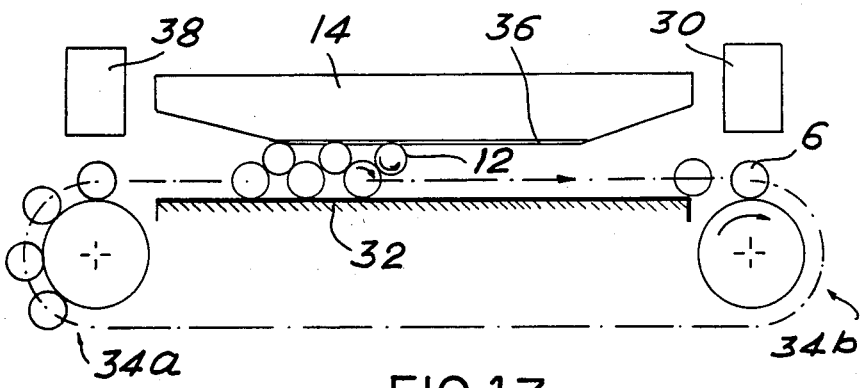
FIG.13
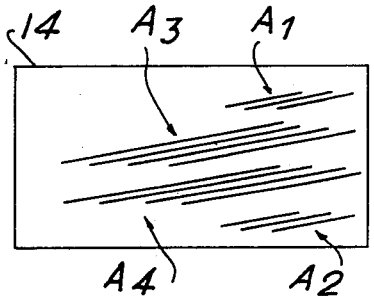
FIG.14
FIG.15
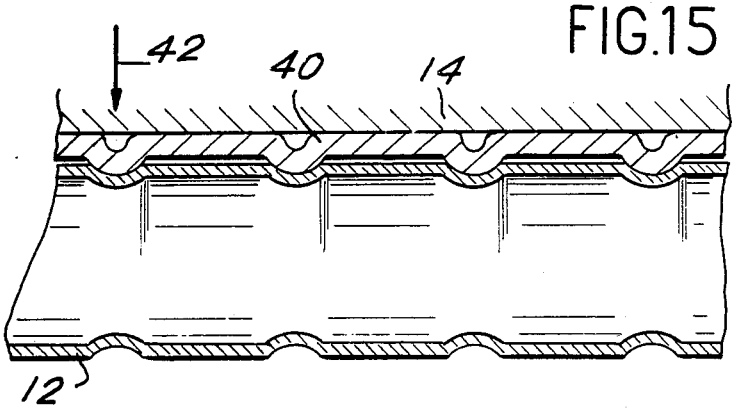

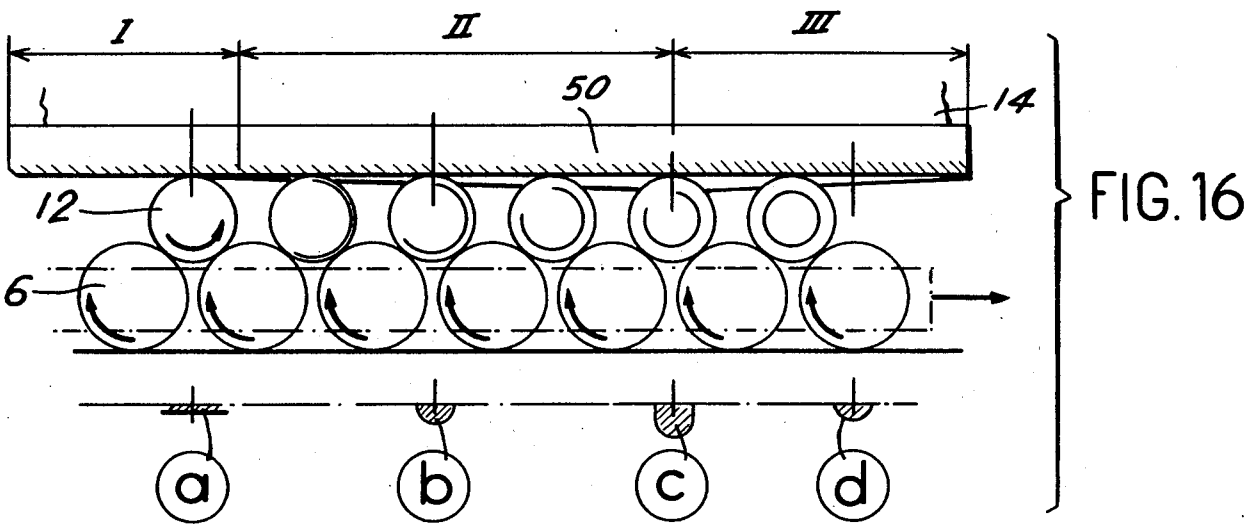
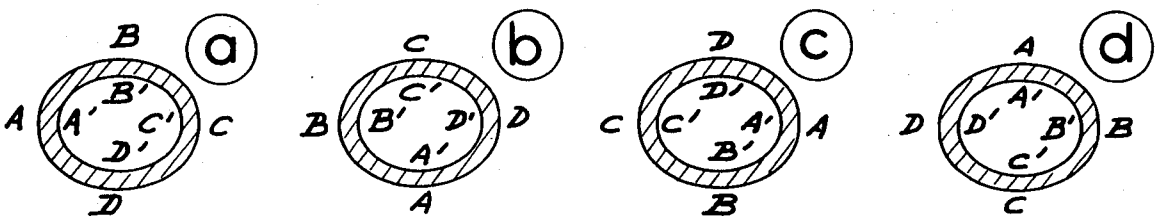
FIG. 17

METHOD OF MANUFACTURING CYLINDRICAL CERAMIC TUBES HAVING LOCALIZED IMPRINTS ON THEIR INNER FACES

The invention also relates to apparatuses for making localized imprints.

Even more precisely, the invention relates to a method of manufacturing permeable cylindrical ceramic tubes having on their inner faces localized reliefs, such as annular or helical imprints or single helixes or double crossed helixes, or even point imprints.

BACKGROUND OF THE INVENTION

One of the techniques for separating gas mixtures having similar molecular masses is of course gas diffusion. In this technique the gas mixture is circulated under pressure inside tubes formed by a microporous wall. In a known technique the tubes are formed on the one hand by a macroporous ceramic tube, generally known as a support, which is lined with a microporous layer deposited on such inner wall. The assembly formed by the tube or "support" itself and the microporous layer enables the total porosity of the coated tube or "barrier" to be adapted so as to obtain an optimum coefficient of gas separation. This technique is more particularly used for the separation of two gases corresponding to different isotopes of the same single body.

However, it has been found that when gas flows inside the barriers or tubes, one of the phases accumulates to some extent on the inner surface of the tube. This is why according to the invention the inner face of the tubes is formed with reliefs to set up considerable turbulences in the gas inside the tubular elements, so as to prevent such an accumulation of one of the phases and thus to enhance the coefficient of separation by gas diffusion.

The invention relates exclusively to the making of the support—i.e., the macroporous tube. In the most conventional form, such cylindrical tubes are made by the usual ceramic methods—i.e., by the mixing of ceramic oxides, thermally eliminable organic binders and a liquid phase (generally water). After these main elements have been mixed, the mixture takes the form of a plastic, deformable paste which is turned into a tube by means of a piston press or a screw extender. The paste is introduced into the press cylinder and forced under pressure through an annular space bounded by an outer nozzle and an inner punch, which define the external and internal diameters of the tube to be produced.

When cut to the required length, the tube is then placed on rollers which rotate and advance in a drier whose temperature enables the liquid phase to be eliminated and results in a non-deformable, robust tube which can be handled or automatically conveyed to the other installations for performing the subsequent operations of preliminary firing (elimination of organic binders) and actual firing at elevated temperature, which gives the tube the required properties (for example: permeability, dimensions of pores) and a high mechanical strength, the tube being then if necessary conveyed to other installations for transforming the material.

On emerging from the molding machines (a screw extruder or the like) the element takes the form of a tube which is plastically deformable but relatively resistant to elongation and tearing.

The method of making reliefs or imprints on the inner face of the tube is carried out at this stage in tube processing.

BRIEF SUMMARY OF THE INVENTION

In its main embodiment, the imprinted tube manufacturing method according to the invention is based on the fact that on emergence from the tube-molding assembly, the tubes are placed on rollers which rotate the tubes and advance to the drier, the rollers rotating without sliding over a real or fictive fixed surface. A tool placed on the tubes which it supports is also fixed. As a result, imprints can be made on the tubes while they are still deformable by applying to them absolutely fixed tools which deform the tubes locally and produce permanent imprints on their inner faces, the imprints being of a shape and profile determined by the tools and the mode of relative displacement of the tubes and the tools.

In this general mode of putting the invention into effect, two preferred embodiments are envisaged.

In a first embodiment, the rollers for rotating tubes comprise imprints in relief, and a horizontal plate is applied to the tubes to be deformed so as to exert a certain pressure of the tubes on the imprints in relief on the rollers. This method enables annular imprints to be made. One very promising economic method of making such rollers with imprints is to slip elastomeric toroidal joints on to the rollers. However, it is more difficult to design things in such a way that all the rollers of the drying assembly are equipped with toroidal joints or imprints in relief. It is more economical to provide one roller element which receives the tubes when they emerge from the tube-making means. At this stage pressure is applied to the tubes, which are then transferred on the smooth rollers of the actual drier.

In a second embodiment, which allows more varied configurations of imprints and is evidently more industrial and economic, the tubes are deposited on perfectly cylindrical rollers, which can in this case be the rollers of the drier itself, and tools whose arrangement and profile enable the required imprints to be made are applied to the tubes.

The tools can be a corrugated plate or tools formed by rods or tubes attached to a panel. If the rods or tubes are disposed perpendicularly to the axis of the tubes to be shaped, the resulting imprint is annular. The tools can also be formed by continuous rods or tubes or by series of discontinuous tubes disposed in quincunx so as to reduce the load distributed over the tube, such load tending to reduce its diameter, so as to apply a more localized pressure.

The tools can also be formed by rods or tubes inclined in relation to the axis of the tubes to be marked. In that case the imprint is a helical groove. The tools can be formed by a single run to produce a continuous helical marking over the whole length of the tube or several tubes, so as to produce tubes having marked zones alternating with the zones remaining smooth.

Also in the latter case the slope of the tools can alternate, so as to produce helical markings of inverse sense, the pitch of which can be modified by changing the angle of the tools in relation to the axis of the tube.

It is also possible to make a tool comprising a succession of parallel tubes or rods of increasing diameter, so that the imprint is made by a very point-shaped punch at the start of the operation and is widened by punches of larger diameter in the following phases, until a final imprint of the required size is obtained.

Finally, tubes can be made which comprise point impressions. To this end the tool bearing against the tubes can be provided with judiciously disposed localized reliefs.

However, it has been found that in some cases the aforedescribed method in these two main embodiments might have certain disadvantages, because in order to obtain sufficiently marked narrowings or imprints it may be necessary to deform the tube locally, as it passes beneath the imprint-forming tools, by an amount appreciably greater than the desired permanent residual deformation. The elementary deforming operation may also have to be repeated several times in order to obtain an adequate depth of imprint, for example, by making the tube run over a path corresponding to several rotations beneath rods or tubes disposed perpendicularly to the axis of the tube. In both cases, that part of the tube which does not contact the imprint-forming tools is also deformed: its section adjacent the imprint-forming tool is no longer circular, but oval to a varying degree. To enable the tube to return to a circular profile after its passage beneath the tubes or wands, the longitudinal profile of the latter comprises on the tube outlet side a zone of gentle slope, in which the pinching of the tube between the imprint-forming tools and the rollers for advancing the tubes, and therefore the ovalization thereof diminish progressively until they are cancelled out. More precisely, over the whole length of the rods or tubes, or more generally of the imprint-forming tools, the rolling of the tube to be marked which is pinched between the tools and the rollers causes it to undergo a "rolling ovalization", which is characterized by the succession of profiles illustrated in FIG. 17. This rolling ovalization causes the appearance of tensile stresses on the surface of the tube at points A, B', C and D' (FIGS. 17*a* and 17*c*) and points A', B, C' and D (FIGS. 17*b* and 17*d*). As a result, each zone of the inner and outer surfaces of the tube is subjected alternately to tensile and compressive stressing during their passage beneath the imprint-forming tubes or tools. This alternating stressing is not taken very well by the paste of which the tube is made, and may cause the appearance of cracks, due to fatigue.

This is why the invention also relates to two improved embodiments which enables such introduction of stresses during the formation of the imprints on the tube to be eliminated, or at least reduced.

In a first preferred improved embodiment, use is made of heated imprint-forming tools. This enables the zones of the tube to be deformed to be heated by contact and selectively. It has been found that, since the thermal conductivity of ceramic pastes is low, the zone heated by the imprint-forming tools extends throughout the thickness of the tube, on condition that such thickness is not excessive, but its width remains small—i.e., those zones of the tube which do not come into contact with the imprint-forming wands remain cold. Since the viscosity of the liquid, glue, grease or other product used as a binder of the ceramics of which the tubes are made, and therefore the resistance to deformation of such paste, decrease appreciably when the temperature rises, the localized heating of the paste by the imprint-forming tools softens the paste locally and therefore enables it to be readily deformed. On the other hand, those zones of the tube which are not to be deformed remain relatively rigid.

The use of these heated imprint-forming tools have the following advantages. Imprints of greater depth can be obtained for the same number of rotations of the tube beneath the tools, or for the same pinching of the tube between the tools and the rollers.

At the same time the tendency of the tube to crack is appreciably reduced, so that its mechanical strength after fritting is no longer reduced, as was the case in the absence of heating since, a deeper imprint being rapidly obtained, that zone of the tube which does not come into contact with the imprint-forming tools undergoes a rolling ovalization of less intensity.

Of course, the imprint-forming tools can be heated by different means, which will be disclosed hereinafter.

A second improved embodiment of the method according to the invention consists in the use of imprint-forming tools which are subjected to vibrations. The use of such vibrating tools has the following advantages:

Deeper imprints can be obtained for the same number of rotations of the tube beneath the tools and for the same pinching of the tube between the rods and the driving rollers.

At the same time the tendency of the tube to crack is appreciably reduced, so that its mechanical strength after fritting is no longer reduced, as is the case if vibratory phenomenon is not put into effect. Since a deeper imprint is more quickly obtained, that part of the tube which does not come into contact with the imprint-forming wands or tools undergoes a rolling ovalization of less intensity.

The imprint-forming tools can be vibrated by any appropriate means, for example, by means of an electromagnet supplied with an alternating current, or by means of a rotating eccentric mass rotated by a motor attached to the frame supporting the imprint-forming tools, or by any other vibratory device disposed on such frame. The vibration can be exerted parallel with or perpendicularly to the axis of the tubes to be formed, or in several directions at once (for example, rotary vibration).

Clearly, these two improved embodiments of the method can be combined—i.e., heated imprint-forming tools can be used which are at the same time subjected to vibrations, as indicated hereinbefore.

The invention also relates to the various apparatuses for putting the method in its different variants into effect.

The invention also relates to the permeable porous ceramic tube having the different forms of imprint which can be made, for instance, by putting the method according to the invention into effect in its different variants. Reference may be made more particularly to annular imprints, helical imprints, and localized or point imprints.

DESCRIPTION OF DRAWINGS

In any case, the invention will be better understood from the following description of its various embodiments and the apparatuses used for putting the methods into effect. The description refers to the adjoining drawings, wherein:

FIGS. 10 and 11 are views from below of the pressure tray having tools for making helical imprints, FIG. 12 is a view from below of the pressure tray having tools for making localized imprints, FIG. 13 is an overall view of an apparatus for making imprints, FIG. 14 is a view from below of the pressure tray, showing tools for making helical imprints by means of tools having increase in thicknesses, FIG. 15 is a view in vertical section of a pressure tray formed by a corrugated metal sheet, FIG. 16 are an elevation and cross-section of an apparatus with heating tools for making imprints, and FIG. 17 are diagrams representing cross-sections of a tube in the course of imprint-making, to show the deformations undergone by the tube.

DETAILED DESCRIPTIONS OF THE PREFERRED EMBODIMENTS

FIGS. 1–4 show in vertical section different imprints which can be obtained by means of the method in its different variants.

Figure 1:
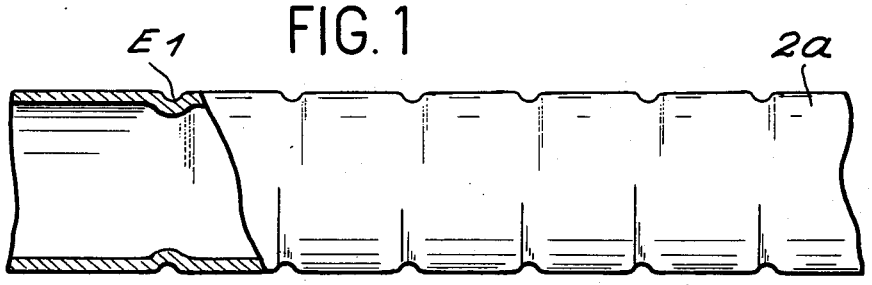
FIGS. 1–4 show tube portions comprising different forms of imprint in relief.
Figure 2:
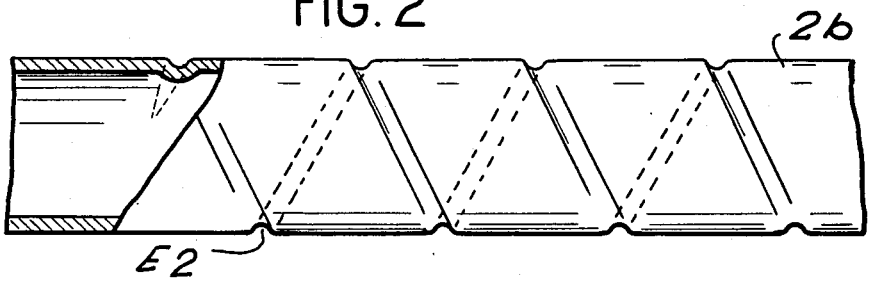
Figure 3:
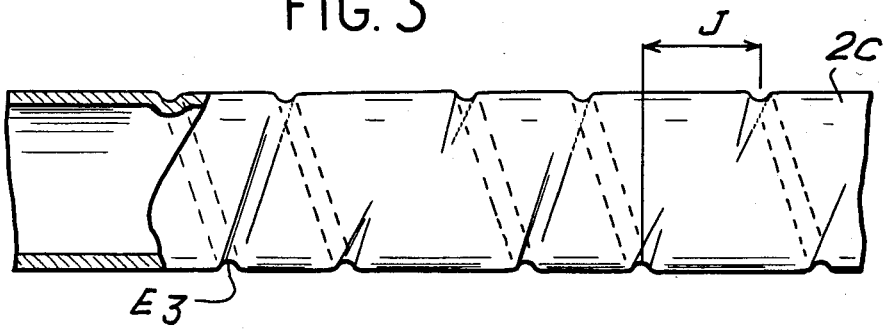
Figure 4:
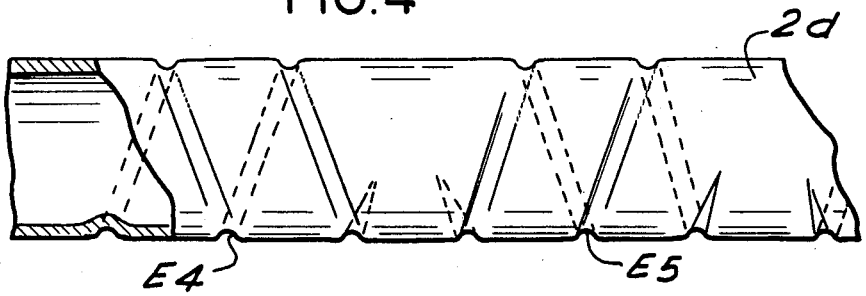

In FIG. 1 a tube 2a has annular imprints $E_1$. In FIG. 2, a tube 2b has helical imprints $E_2$. FIG. 3 shows a tube 2c marked with helical imprints $E_3$, spaces J being left in the axis of the tube between series of three helixes. FIG. 4 shows the tube 2d formed with four zones marked by helixes $E_4$ and $E_5$ of opposite sense.

Figure 5:
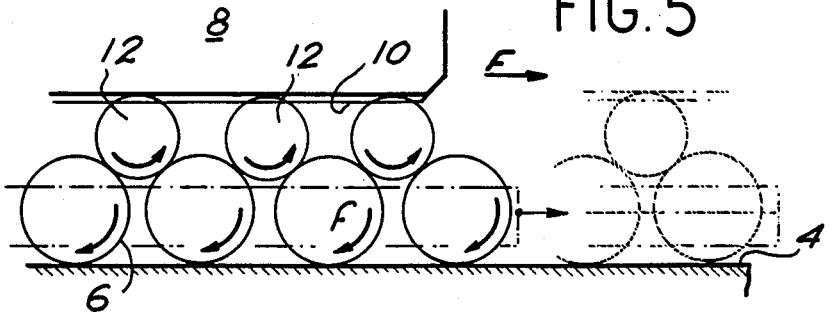
FIG. 5 shows an apparatus for making an imprint, with a single tool borne by a pressure tray.

FIG. 5 shows diagrammatically some apparatus for putting the method into effect. The apparatus has a horizontal support 4 on which rollers 6 can roll without sliding in the direction indicated by arrows f. The apparatus also has a tool-carrier 8 to which tools, as 10, are attached to make imprints in tubes 12, as stated hereinbefore. The rotary movement of the rollers 6 on the one hand causes the tubes 12 to rotate around their own axis, while at the same time causing a general translation movement of the tubes in the direction shown by the arrow F. That is, rotating the driving rollers 6 about their axes in the same direction causes a translatory movement of the driving rollers, which roll without sliding on the horizontal support 4. Of course, the tool carrier 8 and therefore the tools 10 are immobile in relation to the plane support 4 and enable, for example, one of the imprints to be made in an annular shape. It must also be made clear that the tubes 12 are placed on the driving rollers 8 immediately on emergence from the molding means. The ceramic material forming the tubes 12 is therefore still relatively malleable.

Figure 6A:
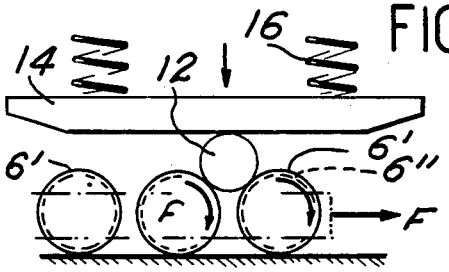
FIGS. 6*a* and 6*b* show an imprint-making apparatus in which the tools are borne by the rollers which advance the tubes, FIGS. 6'a and 6'b are a side elevation and an axial section of a procedure using a ring roller which exerts pressure on the portion of the tube to be deformed, FIGS. 6"a and 6"b are an elevation and axial section of a variant of the device in which three ring rollers exert pressure on the portion of the tube to be deformed.
Figure 6B:
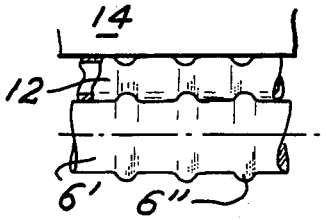

FIGS. 6a and 6b show a second apparatus for putting a variant of the method into effect. In a general way, with the use of this apparatus imprints are no longer made by a tool which applies a pressure to the tubes driven by the rollers, but by tools which are directly devised on the driving rollers, the force applied by the tools being obtained by a member which retains the tubes in relation to the rollers. More precisely (FIGS. 6a and 6b) there is a carpet of rollers 6' which, as can be seen more clearly in FIG. 6b, comprises toroidal imprints 6" adapted to produce the shape of the imprint in the tubes. On the one hand the rollers rotate the tubes 12, and on the other hand the rollers are subjected to a general translation movement in the direction indicated by arrow F (perpendicularly to the axis of the tubes 12). As has been stated, a pressure tray 14 associated, for example, with a spring device 16, ensures the immobilization of the tubes 12 in a vertical direction in relation to the rollers 6' having the tools 6". Such an apparatus can be used to obtain, for example, the annular imprints shown in FIG. 6b.

The tools 6", which are cylindrical rims, can be machined in the body of the rollers 6 or be added in the form of rings formed by toroidal joints.

FIGS. 6'a and 6'b illustrate an apparatus for a third embodiment of the method which in a certain way combines the embodiments shown in FIGS. 5 and 6. Two driving rollers 106 and 106' are provided on which the tube portion 12 is placed which is to carry the imprints. A third roller 108 (ring roller) can be lowered to apply a pressure to the tube 12 to be deformed, the roller 108 comprising reliefs 110 (FIG. 6'b) which enable annular imprints 112 to be made. The roller 108 can also rotate around its axis XX', the result being a minimum amount of sliding and friction between the tube 12 to be deformed and the ring roller 108.

FIGS. 6"a and 6"b show a variant of the apparatus for the third embodiment of the method according to the invention. In this variant not only the roller 108 bears reliefs 110, but also the two driving rollers. In other words, there are three identical rollers 108 whose surfaces are formed with reliefs 110. When the rollers 108 rotate, each imprint in the tube is formed simultaneously by the action of the reliefs on the three rollers.

Figure 7A:
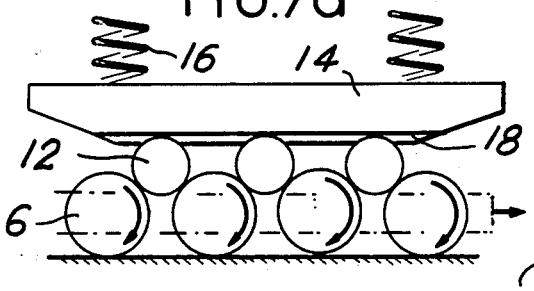
FIGS. 7a and 7b show an apparatus in which the pressure tray comprises a number of tools for making annular grooves.
Figure 7B:
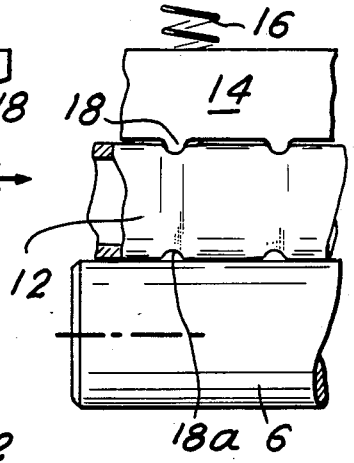

The apparatus shown in FIG. 7 is similar to that shown in FIG. 5—i.e., again it has the rollers 6, but instead of there being only one tool 8, use is made, as in FIG. 6, of a pressure tray 14 associated with a resilient device 16 and having mounted on its lower face imprint-making tools 18. As shown more clearly in FIG. 7b, the tools have, for instance, a rounded active face 18a for making groove-shaped imprints. Of course, this apparatus could have tools of different shapes for making a suitable form of imprint on the tubes 12.

Figure 8:
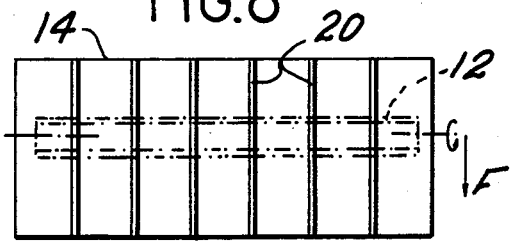
FIG. 8 is a view from below of the pressure tray shown in FIG. 7a, FIG. 9 is a view from below of the pressure tray in an apparatus comprising three offset series of tools.

FIG. 8 is a view from below of a pressure tray 14 on which tools 20 are mounted for making annular imprints. The tools cover the whole width of the pressure tray and can have a shape adapted to the section of the imprint to be made in a plane of section perpendicular to their length.

FIG. 9 shows tools comprising three interconnected pressure trays 14a, 14b and 14c, each tray having imprint-making tools 22. The tools made one imprint out of three. In other words, if we note by p the pitch of the final imprints with which the tube is to be provided, the tools 22 of the same tray are offset by a length equal to 3p, and a tool of a tray is offset by a length p from the tool of the adjacent tray.

FIG. 10 is a view from below of a pressure tray 14 having imprint-making tools 24 which are inclined in relation to the axis of displacement of the tubes. The tools 24 enable helical imprints to be made with a pitch p'.

FIG. 11 shows a tray 14 of the same type which has tools 24' enabling helixes of inverse sense to be produced.

The tray 14 shown in plan view from below in FIG. 12 has localized punches 26 which enable point imprints to be made on the tubes.

FIG. 13 shows the installation in greater detail. It comprises on the one hand a charging station 38 which enables the tubes emerging from the molding means to be placed on the rollers 6. The rollers 6 are driven in translation and rotation by a belt assembly 32 rotated by end wheels 34*a* and 34*b* which tension and rotate the belt. The apparatus also comprises pressure tray 14 having tools 36 and a station 30 for the unloading of the tubes furnished with their imprints.

FIG. 14 shows another form of tool enabling series of helical imprints to be obtained. On the lower face of the pressure tray 14, at the two ends there are two zones $A_1$ and $A_2$ formed by short tools, 5 tools in this case, and two zones $A_3$ and $A_4$ formed by longer tools inclined in relation to the axis of the tray. These zones are each formed by five tools whose diameter progressively increases from right to left. As shown in FIG. 15, instead of having a tray 14 to which the imprint-making tools are attached, the tray and tool assembly can take the form of a ribbed metal plate 40 associated with spring pressure means 42. In this way, for instance, imprints can be obtained with relatively large radiuses of curvature.

Three actual examples of embodiments of this first form of the method will now be described.

EXAMPLE 1

A method of making porous alumina tubes of external diameter 20 mm, internal diameter 16 mm and 800 mm in length, having annular imprints 0.4 mm deep (measured on the inner surface) and spaced out by 20 mm over a length of 650 mm. Each end has a smooth cylindrical zone of 75 mm.

The tubes left a piston press still completely plastic and deformable and were placed on rollers having a diameter of 42.4 mm and spaced out at intervals of 8.4 mm and moving on a fixed flat surface which gave them an advancing rotary movement towards a drying caisson at a speed of one meter per minute (cf.FIG. 5).

To the sheet of tubes thus formed there was applied a tool system formed by a very flat horizontal tray 700 mm in width and about 1 meter long, above which there were disposed by welding, glueing or any other process, stainless steel tubes of external diameter 8 mm perpendicular to the axis of the tubes to be marked, spaced out by 20 mm, and forming the imprint-making tools; the ends of the tubes were so bevelled that the tubes were progressively deformed at the entry of the tool, emergence therefrom also being regular. The tool system was so disposed in height that the marking tubes were pushed about 2 mm in to the ceramic tubes. So as to prevent the tubes from getting stuck to the driving rollers and the tube-deforming tools, the tubes or rollers were coated with a film of purely organic oil in front of the working zone. After drying and thermal treatment, the tubes had annular imprints of the required dimensions, the method being completely continuous and industrial when put into effect.

Clearly, by modifying the distance between the marking tubes it is easy to obtain any required pitches of annular imprints, and the profile and depth of the imprints can be changed by using tools of different diameter and shapes or by controlling the height of the tool system in relation to the tubes.

EXAMPLE 2

A method of making porous alumina tubes of 20 mm external diameter, 16 mm internal diameter and 800 mm in length, having helical imprints 0.5 mm deep (measured on the inner surface) with a pitch of 20 mm and disposed in four distinct zones: two zones of 70 mm in length, the two ends of the tube being unmarked over 75 mm, and two central zones 210 mm in length.

Each ring zone is thus separated from its neighbour by a smooth reserve of about 30 mm.

The tubes leaving the extrusion press were disposed as in Example 1 on the rotary rollers advancing to the drier. To the carpet of moving tubes there was applied a tool system formed by a perfectly flat tray having attached to its lower face tubes of 7 mm external diameter. There were two tubes 220 mm in length on the lateral portion of the tray and two rods 660 mm in length on the central portions of the tray.

The four tubes were inclined by about 15° in relation to the axis of the tubes to be marked and were parallel with one another. Each tube marked its helix in the corresponding zone, the shorter tools producing the shorter zones. To facilitate the marking of the tubes and to obtain a deeper imprint, the marking tubes were heated to 70°-80° C. by the circulation of heated oil by a thermostatic closed circuit system. The increase in local temperature allowed a slight softening of the tube, which became more deformable.

The operation was followed by drying and thermal treatment, and the resulting tubes had clearly marked helical imprints in the required geometrical arrangement.

EXAMPLE 3

A method of making porous alumina tubes of 20 mm external diameter, 16 mm internal diameter and 800 mm in length, having helical imprints of the same depth and pitch as those in Example 2, but with a much wider profile—i.e., a much larger radius of curvature.

In this case it was impossible to produce the helix with a single, large diameter marking tool, since such a punch deforms and ovalizes the tube without marking it deeply.

However, it was possible to obtain such profiles by making the helix with several small parallel bars of increasing diameter, each tool widening the more localized imprint made by the preceding punch.

Each helix was marked, for example, by five cylindrical tools of diameter 8, 10, 12, 14 and 16 mm which were completely parallel and whose spacing was carefully calculated, so that each tool dropped precisely into the marking made by the preceding punch.

In this case the marking tray was formed by a hollow parallelepipedic frame in which the heating fluid could circulate. One face of the frame was completely flat, with four marking tools attached to it. The tools were formed by plates in which small bars of diameter 8, 10, 12, 14 and 16 mm were produced by milling, each bar being offset in relation to the preceding bar by a length corresponding to one revolution (or one circumference) of the tube to be marked, the offsetting being measured in the direction displacement.

With this apparatus the resulting helixes were wide and deep and the tube was not exaggeratedly elongated in a way which would have reduced its diameter in the intermediate cylindrical portions.

As already stated, it is possible to add to the mechanical deformation of the tube by the tools a localized tube-heating operation in line with the imprints to be made. The heating can be performed in various ways, for instance:

using electric heating resistances. This is particularly advantageous if the imprint-making tool itself forms the heating resistance, by the circulation of a hot liquid in ducts with which the shaping device is formed. One particular case is that in which the shaping tools take the form of wands formed by metal tubes in which the hot liquid circulates. Another case is the one in which the tubes in which the hot liquid circulates are welded along the wands; by infrared radiation directed at the wands, the surface of the tube being protected from such radiation by screens.

In this embodiment of the method, advantageously the zones of the tube to be deformed are heated before the actual deforming operation starts. To this end use is made of shaping tools with a progressive section (FIG. 17). The heating tool 50 has a first zone I, the heating tool 50 has in cross-section the shape shown in FIG. 16*a*—i.e., the tool 50 produces only heating, without any mechanical deformation. In zone II, the tool 50 produces a progressive mechanical deformation (FIGS. 16*b* and 16*c*). In that zone the tool 50 also performs heating. In zone III the section progressively diminishes in thickness (FIG. 17*b*), such zone forming a disengagement zone.

Clearly, although this is not illustrated, the tools shown in FIGS. 5 to 14 can be heating ones. They can either incorporate the heating resistance or be hollow and contain a circulating hot liquid.

Even if it is limited to the zones to be deformed, the heating of the member by the heating tools can cause an undesirable volatilization of certain constituents of the paste from which the tubes is made. To prevent such evaporation, the zone in which the forming operation is performed can be enclosed in an enclosure, in which an atmosphere is maintained which is saturated with the volatile compounds forming the tube. This slows down or completely prevents vaporization. The tube can also be given a preliminary coating with a film of non-volatile compounds such as, for instance, a paraffin oil.

Moreover, in order to avoid the evaporation of the constituents of the paste forming the tube at the point where the surface of the tube comes into contact with the tools, such zones can be coated with a film of non-volatile liquid. More particularly, the liquid can be deposited on the active surface of the tools, from which the liquid is transferred to the tube by the contact taking place during the imprint-making operation.

As already stated also, the imprint-making tools can not only be heated but also vibrated. The two features can also be combined.

The imprint-making tools can be vibrated by any suitable means, more particularly an electromagnet supplied by an alternating current and associated with a magnetic member connected to the tray bearing the imprint-making tools. An eccentric rotary mass can also be used which is rotated by a motor attached to the tool-bearing tray. More generally, use can thus be made of any vibratory device attached to the tool-bearing tray. Vibration can be performed parallel or perpendicular to the axis of the tubes to be deformed or in several directions at once, for instance, by rotary vibration.

We shall now describe comparative examples illustrating the efficiency of the process with heating and the production of vibrations.

The following examples relate to the forming of narrowings of the internal section of tubes formed by a ceramic paste of thixotropic behaviour containing thermoplastic binders having the following characteristics:

internal diameter of the tube: 17 mm
external diameter: 21 mm
speed of advance of tubes over moving belt: 5 mm/sec.
distance between the narrowings to be formed on the tubes: 16 mm
length of the wands (forming the tools) contacting the tube: 500 mm
radius of curvature of the surface of the wands contacting the tube: 6 mm
maximum pinching of the tube between the wands and the belt rollers: 2.5 mm In examples nos. 2 and 4 below, there is rotary vibration around a horizontal axis perpendicular to the axis of the tube, with a frequency of 102 Hz and a peak-to-peak amplitude of 0.2 mm.

The height of the projections obtained on the inner faces of the tubes is as follows:

| | Height of the projections |
|---|---|
| Example no. 1<br>Wands at 20° C., not vibrated | 0.3 mm |
| Example no. 2<br>Wands at 20° C., vibrated | 0.4 mm |
| Example no. 3<br>Wands at 50° C., not vibrated | 0.45 mm |
| Example no. 4<br>Wands at 50° C., vibrated | 0.65 mm |

In the four above examples, the tubes showed no cracking after drying and fritting.

What is claimed is:

1. A method of making imprints on the internal walls of tube portions obtained by the continuous molding of a ceramics-based paste into a continuous tube and the cutting up of the continuous tube into individual tube portions, said method comprising the steps of:

(a) while the tube portions are still deformable, placing the tube portions on a bed of driving rollers disposed on a horizontal support, the axes of the driving rollers being parallel to each other and in the same horizontal plane such that the axes of the tube portions are parallel to the axes of the driving rollers;

(b) rotating the driving rollers about their axes in the same direction, thereby causing a translatory movement of the driving rollers, which roll without sliding on the horizontal support;

(c) applying pressure-exerting means to at least a part of the tube portions so that the tube portions are clamped between the driving rollers and the pressure-exerting means; and (d) imprinting the tubular portions with at least one imprint-making tool provided on either the driving rollers or the pressure-exerting means, the imprint-making tool having a main imprinting direction which does not coincide with the direction of the axes of the driving rollers, by creating a relative movement between the tube portions and the imprint-making tool while permitting substantially no sliding between the tube portions and the imprint-making tool.

2. A method according to claim 1 wherein a plurality of imprint-making tools are provided on either the driving rollers or the pressure-exerting means.

3. A method according to claim 1 wherein the imprints are made by means of at least one imprint-making tool connected to the driving rollers.

4. A method according to claim 1 wherein the imprints are made by at least one imprint-making tool connected to the pressure-exerting means.

5. A method according to claim 1 wherein, at the same time as the tube portions are imprinted, those zones of the tube portions which are to be imprinted are heated.

6. A method according to claim 5 wherein said zones of the tube portions are heated as the tube portions are imprinted.

7. A method according to claim 5 wherein said zones of the tube portions are heated before and during the imprinting of the tube portions.

8. A method according to claim 5 wherein the tube portions are imprinted and heated in surroundings which are saturated with at least one compound adapted to prevent the vaporization of the materials forming the tube portions when the tube portions are heated.

9. A method according to claim 1 wherein the imprint-making tool is subjected to vibrations at the same time as the tube portions are imprinted.

10. A method according to claim 9 wherein such vibrations are exerted parallel to the axes of the tube portions.

11. A method according to claim 9 wherein such vibrations are exerted perpendicularly to the axes of the tube portions.

12. A method according to claim 9 wherein such vibrations are exerted in several directions simultaneously.

13. A method according to claim 1 wherein the tube portions are imprinted by means of at least one imprint-making tool of elongate shape disposed on the pressure-exerting means perpendicularly to the axes of the tube portions.

14. A method according to claim 1 wherein the tube portions are imprinted by means of at least one imprint-making tool of elongate shape disposed on the pressure-exerting means at an inclination in relation to the axes of the tube portions.

15. A method according to claim 1 wherein the tube portions are imprinted by means of punches disposed on the pressure-exerting means, so as to make localized imprints in the tube portions.

16. A method according to claim 1 wherein the final imprints are obtained by the successive action of a number of imprint-making tools adapted to make imprints of increasing size.

17. A method according to claim 1, wherein the imprints are made by a plurality of series of imprint-making tools, each series of imprint-making tools making part of the imprints.

* * * * *